US006298991B1

(12) United States Patent
Tsai

(10) Patent No.: US 6,298,991 B1
(45) Date of Patent: Oct. 9, 2001

(54) PROTECTIVE POUCH

(76) Inventor: Daniel E. Tsai, 39 Bayberry Dr., Atkinson, NH (US) 03811

( * ) Notice: Subject to any disclaimer, the term of this patent is extended or adjusted under 35 U.S.C. 154(b) by 0 days.

(21) Appl. No.: 09/520,520

(22) Filed: Mar. 8, 2000

Related U.S. Application Data

(63) Continuation of application No. 09/034,484, filed on Mar. 4, 1998, now Pat. No. 6,105,778.

(51) Int. Cl.[7] ..... B65D 81/02
(52) U.S. Cl. ..... 206/523; 206/320; 428/36.5
(58) Field of Search ..... 206/305, 320, 206/523, 576; 190/125; 383/109, 110, 119; 428/34.2, 35.2, 35.7, 36.5; 220/670–673

(56) References Cited

U.S. PATENT DOCUMENTS

| | | | | |
|---|---|---|---|---|
| 3,266,705 | * | 8/1966 | Wood | 206/523 |
| 3,273,779 | * | 9/1966 | Mykeby | 206/523 |
| 3,460,740 | * | 8/1969 | Hagen | 383/110 |
| 3,948,436 | * | 4/1976 | Bambera | 206/523 |
| 4,011,798 | * | 3/1977 | Bambera et al. | 206/523 |
| 4,087,022 | * | 5/1978 | Bambera et al. | 206/523 |
| 4,185,673 | * | 1/1980 | Daniello | 206/523 |
| 4,211,267 | * | 7/1980 | Skovgaard | 383/110 |
| 4,394,906 | * | 7/1983 | Hollenbeck | 220/672 |
| 4,733,776 | * | 3/1988 | Ward | 206/523 |
| 4,868,025 | * | 9/1989 | Strzelewicz | 383/109 |
| 4,934,534 | * | 6/1990 | Wagner | 206/523 |
| 5,169,024 | * | 12/1992 | Rinkewich | 220/673 |
| 5,524,754 | * | 6/1996 | Hollingsworth | 206/320 |
| 5,573,129 | * | 11/1996 | Nagata et al. | 220/672 |
| 5,970,979 | * | 10/1999 | Christofel et al. | 128/849 |
| 6,049,938 | * | 4/2000 | Jimison | 383/109 |

* cited by examiner

*Primary Examiner*—Jim Foster
(74) *Attorney, Agent, or Firm*—Fish & Richardson P.C.

(57) ABSTRACT

A protective pouch has a closed cell foam padding and a casing enclosed around the closed cell foam padding. The configuration forms two opposing curved sidewalls. The protective pouch has a closing mechanism, which can be a flap extending from one sidewall and attached to the other sidewall. The pouch can be substantially fitted for a rectangular object so that when the object is inside said pouch, the object forms protective pockets between the sidewalls of the object and opposing sidewalls of the pouch.

10 Claims, 8 Drawing Sheets

PROTECTIVE POUCH

This application is a continuation of application Ser. No. 09/034,484 filed on Mar. 4, 1998, now U.S. Pat. No. 6,105,778.

BACKGROUND OF THE INVENTION

This invention relates to a carrier to transport items.

Manufacturers have devised cases for carrying items. Examples of cases include luggage, briefcases and computer carriers. In particular, for computer carriers that hold a portable computer, the typical carrier resembles a briefcase. The cases have the same (i.e., rectangular) shape as the computer. The cases are made of either a hard material or soft material. The cases afford some protection to their contents.

SUMMARY OF THE INVENTION

In general, the invention features a pouch having two opposing, curved sidewalls. Each curved sidewall has a padding layer and a casing on an exterior portion of the padding layer. In one embodiment, the casing and padding are arranged such that the casing is in tension with respect to the padding layer. The tension causes the opposing sidewalls to curve.

The pouch has a closing piece, such as a flap extending from one opposing sidewall and attaching to the other opposing sidewall. The padding layer can be a corrugated material or a closed cell foam material. The padding layer can also have a series of folds and ridges that run in parallel with the curvature of the sidewall of the pouch.

The pouch is configured to deform so that it absorbs and distributes any impact energy imparted to the pouch. The pouch can be substantially fitted for a rectangular object so that such an object inside the pouch forms protective pockets between the object and sidewalls of the pouch.

BRIEF DESCRIPTION OF THE DRAWINGS

The foregoing features and other aspects of the invention will become more apparent from the drawings, taken together with accompanying description, in which.

DETAILED DESCRIPTION

Figure 1:
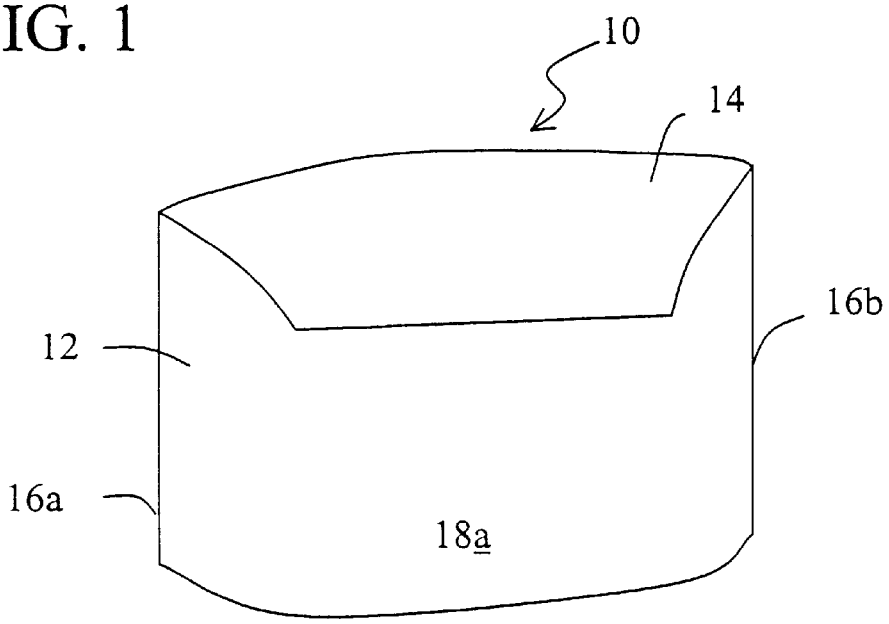
FIG. 1 is a perspective view illustrating a protective pouch.

Referring now to FIG. 1, a protective pouch 10 having an outer protective covering 12 and a closure flap 14 is shown in a closed position. In one embodiment, outer protective covering 12 and flap 14 are comprised of a suitable fabric-type material that is stitched at seam 16*a* and seam 16*b*. The pouch is sized to hold a fragile device such as a portable computer. The configuration of the pouch 10 and the materials of the components of the pouch 10 are provided to impart shock absorbing properties to the pouch as will be described. The pouch 10 protects its contents by a number of mechanisms in the event of impact from an outside force, such as by dropping the pouch and its contents on the ground.

Figure 2A:
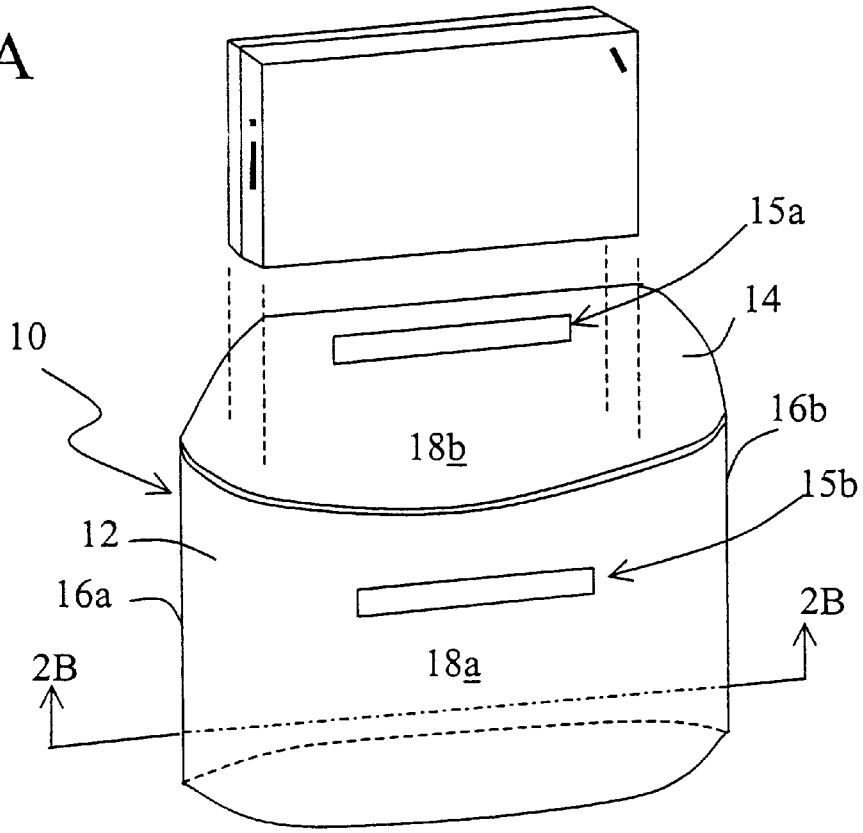
FIG. 2A is a perspective view illustrating the pouch of FIG. 1 in an open position with a portable computer being inserted.
Figure 2B:
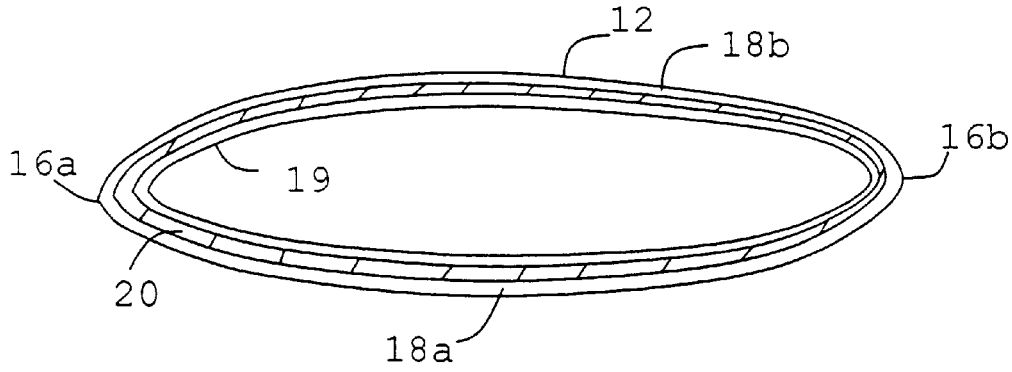
FIG. 2B is a cross-sectional view taken along line 2B—2B of FIG. 2A.

Referring now to FIGS. 2A and 2B, the pouch 10 is shown in an open position with flap 14 open revealing a pair of Velcro®, Velcro Industries, strips 15*a*, 15*b*. One Velcro® strip 15*a* is attached to the inside of flap 14 and the mating Velcro® strip 15*b* is attached to a front sidewall 18*a* of the pouch 10. A back sidewall 18*b* is also provided. Both sidewalls 18*a*, 18*b* are joined along seams 16*a*, 16*b* and are configured to have an outwardly curved surface.

In particular, as shown in FIG. 2B, the pouch includes the outer protective covering 12 of fabric or other outer protective covering arranged about a padding layer 20. The outer protective covering 12 is configured to be placed in tension between seams 16*a*, 16*b* with respect to padding layer 20 so as to cause the sidewalls of the pouch 10 to curve outward. This curvature provides the pouch 10 with shock absorbing and cushioning properties when the pouch 10 is used to protect an object. The shock absorbing property results from a spring-like force. The spring-like force must be overcome by an external force to cause the sidewalls to collapse before the external force can act on an object in the pouch 10. The shock absorbing properties of the sidewalls are in addition to the intrinsic protective properties afforded by the characteristics of the materials used to make the pouch.

A suitable fabric material for the outer protective covering 12 includes a rip-stop Nylon®. The pouch 10 optionally includes an inner liner 19 disposed to cover the padding layer 20. The inner liner 19 need not be the same material as the outer protective covering 12.

Figure 3A:
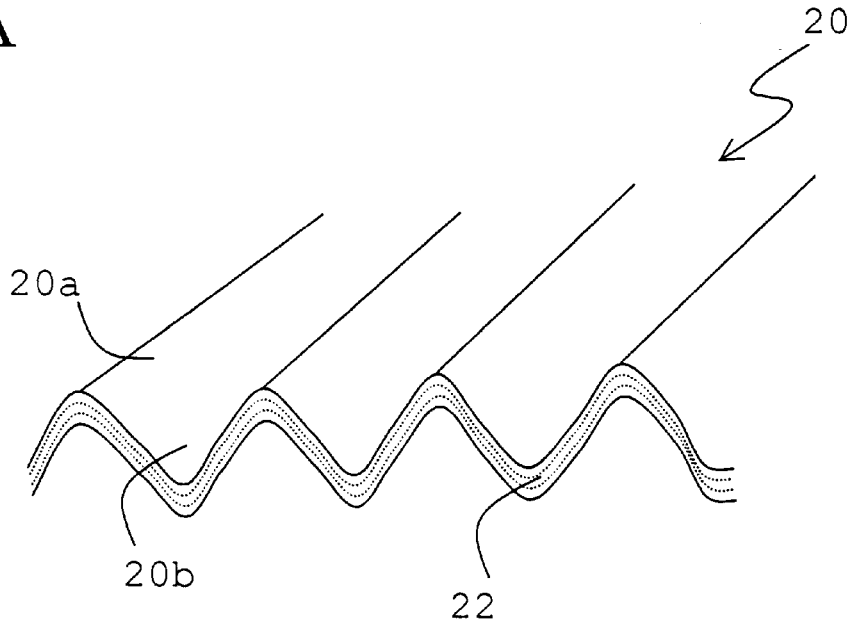
FIG. 3A is a cross-sectional perspective view illustrating a padding layer for the pouch of FIG. 1.

Referring now to FIG. 3A, one embodiment of the padding layer 20 is shown. The padding layer 20 is comprised of a foam material and is arranged as a plurality of here evenly spaced alternating ridges 20*a* and folds 20*b*, or corrugations resembling waves that extend over the surface of the padding layer 20. The corrugations are provided to stiffen the foam in an in-plane, lateral direction orthogonal to the corrugations. When this foam layer 20' is used within the pouch, the corrugations are preferably disposed parallel with the curved surface of the sidewalls. The combination of the curved surface of the sidewalls and the corrugations cause the pouch to have substantial rigidity and enables the pouch to have the curved sidewalls and conform to a generally oval type shape as shown in FIG. 2B.

In one embodiment of the padding layer 20, the foam layer 22 is comprised of a closed cell foam that provides a degree of cushioning to the padding. Alternatively, an open cell foam material could be used but an open cell foam is less preferred because of its typical water absorbent properties.

Figure 3B:
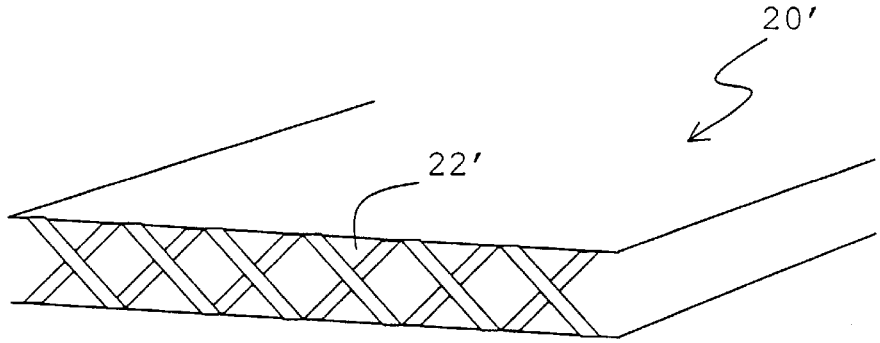
FIG. 3B is a cross-sectional perspective view illustrating an alternate embodiment of the padding layer for the pouch of FIG. 1.

Referring now to FIG. 3B, an alternative embodiment 20' of the padding layer is shown. Foam material 22' (either open or closed cell) is configured as crossed layers that deform upon impact.

Figure 3C:
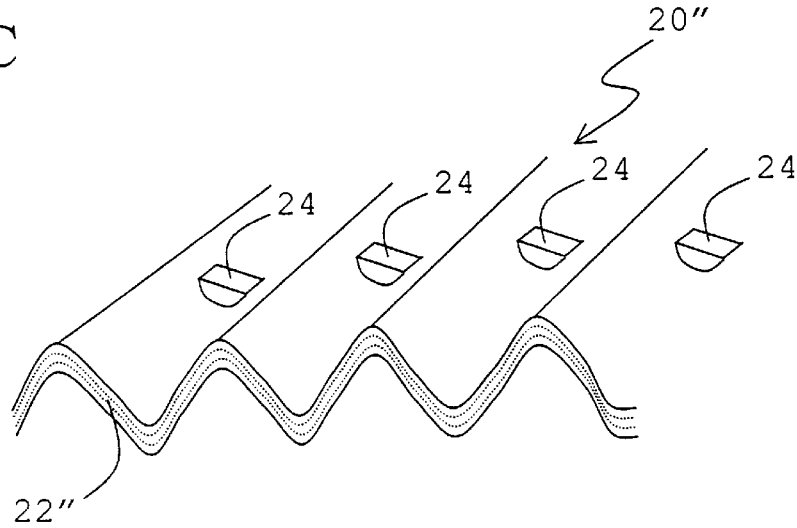
FIG. 3C is a cross-sectional perspective view illustrating a still further alternate embodiment of the padding layer,for the pouch of FIG. 1.

Referring now to FIG. 3C, another alternative embodiment 20" of the padding layer 20 is shown. Padding layer 20" includes the closed cell foam layer and the corrugated portions of the embodiment of FIG. 3A, as well as, spacers 24 disposed between ridges to provide the foam layer 22" with additional resistance to deforming in the lateral direction. One type of foam that has this configuration is Ridge-Rests® closed cell foam material (available from Cascade Designs) and is disclosed in U.S. Pat. No. 4,980,936 incorporated herein by reference.

Figure 3D:
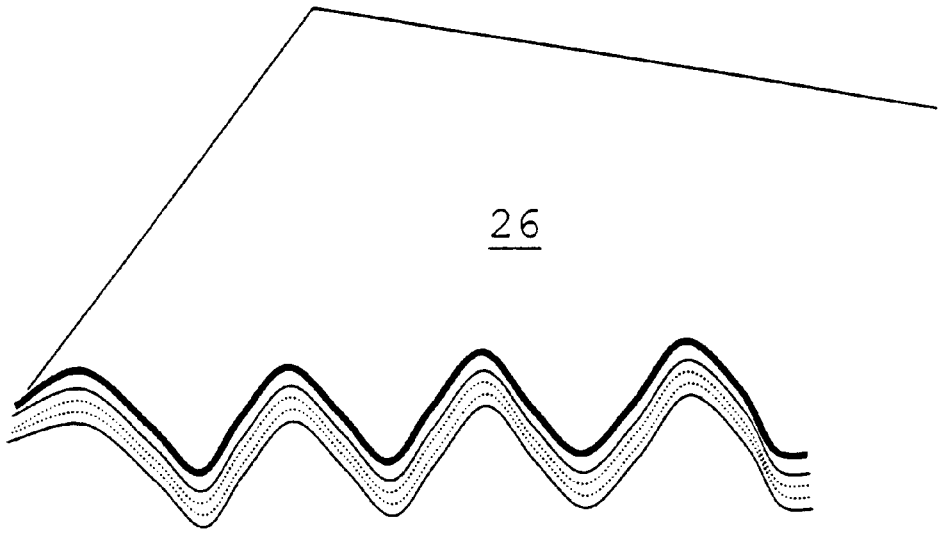
FIG. 3D is a perspective view illustrating a padding layer having a showed plastic coating useful in the pouch of FIG. 1.

Referring now to FIG. 3D, padding layer 20 is shown having a thin hard covering surface 26 over a padding layer. As shown the surface 26 is disposed over the corrugated portions of either the padding layer 20 or 20". The hard covering surface 26 is a plastic or other type of material or film such as Kevlar® from Dupont and can act as the outer protective covering of the pouch or an additional protective layer between the padding layer 20 and outer layer 12. The hard covering 26 is characterized as having a hardness that is substantially greater than the hardness of the underlying padding layer. The hard covering surface 26 can be molded into a curve shape to dissipate energy across the outer case. The hard covering surface 26 can also be curved ribs that form a rib cage.

Figure 4A:
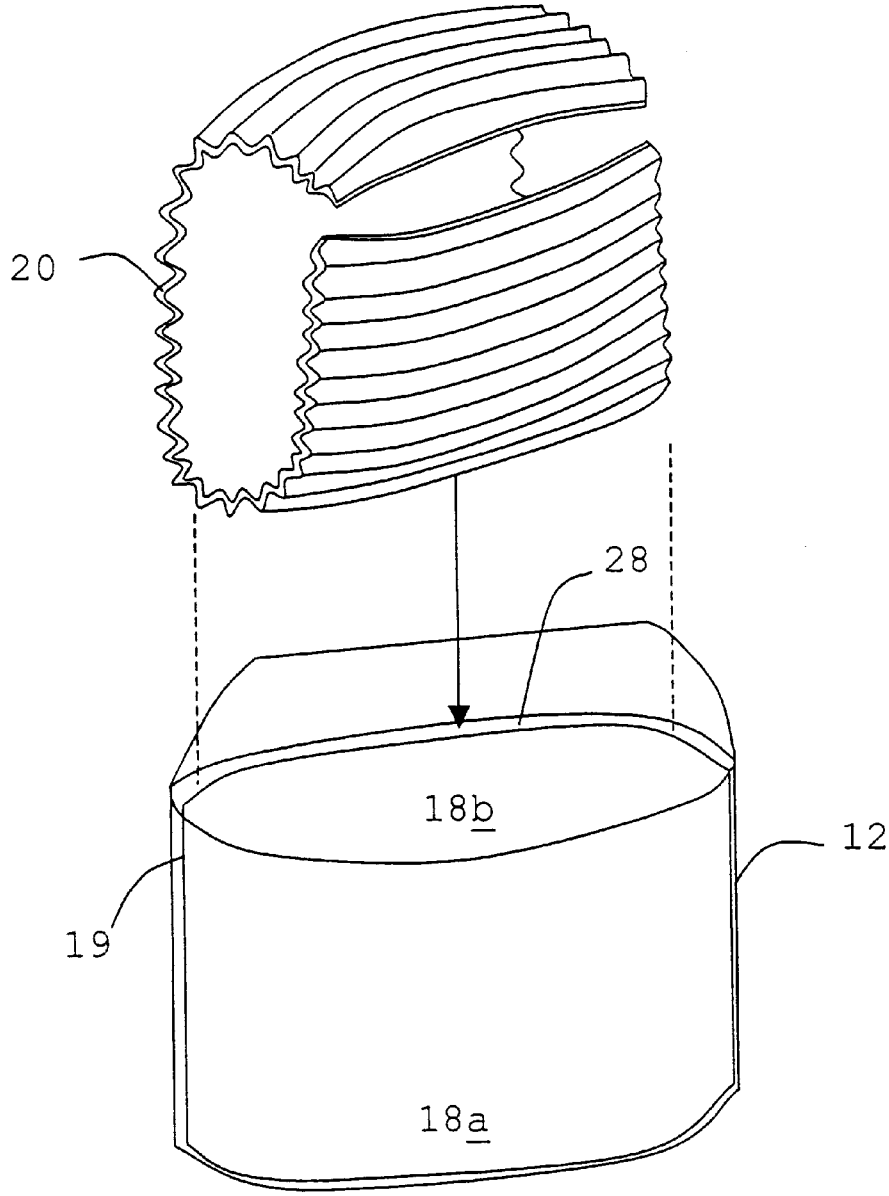
FIG. 4A is a perspective view of an alternate embodiment of a pouch.

Referring now to FIG. 4A, the inner lining 19 and outer protective covering 12 can be arranged to form a sleeve 28 within which the padding layer 20 is inserted. The dimensions of the sleeve 28 and hence the surface area of the inner layer 20 and the surface area of the outer protective it covering 12 are selected so that when the inner layer 20 is inserted into the sleeve, the outer surface area curves outwardly imparting the illustrated curved surface to the front sidewall 18*a* and the back sidewall 18*b*. By configuring the outer protective layer 12 and the padding layer 20, in this manner, the combination provides a spring-like property to the sidewalls 18*a*, 18*b* of the pouch to increase the ability of the pouch to protect its contents.

Figure 4B:
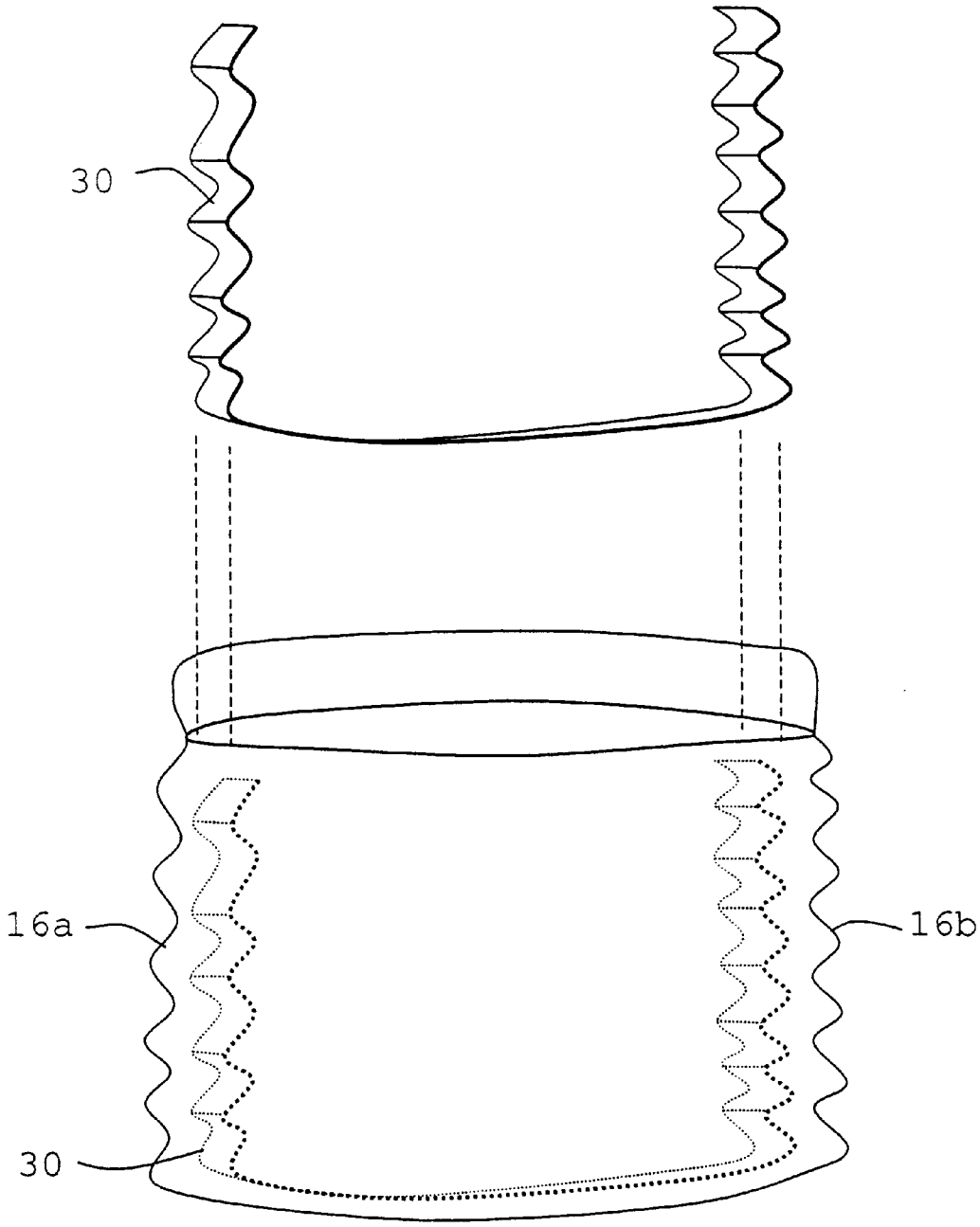
FIG. 4B is a view of a side padding for the pouch of FIG. 4A.

Referring now to FIG. 4B, the padding layer 20 can have a sidewall padding layer 30 disposed along the edges of the pouch while the sidewalls 18*a*, 18*b* of the pouch 10 are still maintained in curvature. The sidewall padding layer 30 is inserted adjacent the pair of seams 16*a*, 16*b* and along the bottom of the pouch 10.

Figure 4C:
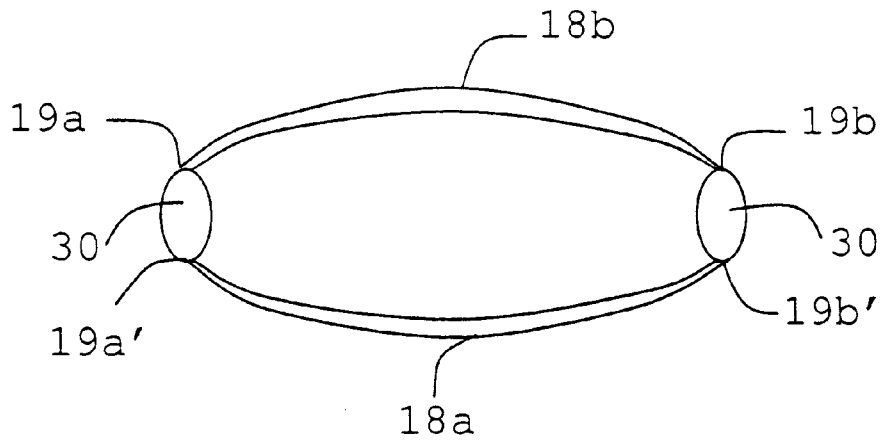
FIG. 4C is a cross-sectional view showing side padding.

Alternatively, as shown in FIG. 4C, the sidewall padding can be placed between a pair of seams along each of the edges of the pouch. Each sidewall 18*a*, 18*b* of the pouch would be coupled between a corresponding pair of seams 19*a*, 19*a* ' and 19*b*, 19*b* ' so that the outer layer of each sidewall 18*a*, 18*b* is disposed in tension between the pair of corresponding seams with respect to the padding layer 12. The sidewall padding layer 30 is inserted to provide additional shock absorbent properties and protection along the sidewalls 18*a*, 18*b* to an object contained in the pouch 10.

Figure 5:
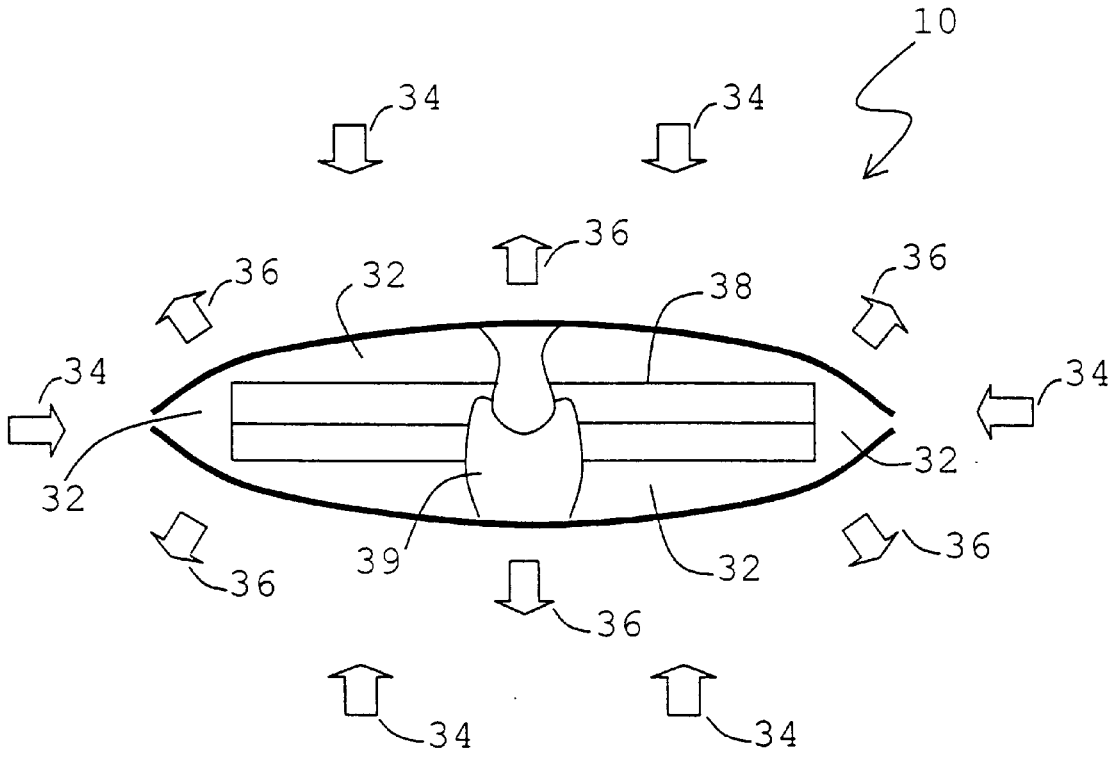
FIG. 5 is a top view of FIG. 2A illustrating protective pockets surrounding the contents inside a pouch.

Referring now to FIG. 5, the pouch 10 is shown housing an object 38, such as a portable computer. Because the object 38 is rectangular and the configuration of the pouch is oval-like, protective pockets or spaces 32 are formed between sidewall surfaces of the object 38 and opposing portions of the interior of the pouch 10. During impact against the outside of the pouch, the presence of the protective pockets 32 diminish the impact force imparted to the object 32 because the sidewalls of the pouch 10 flex or compress to fill the pockets and thus dissipate a portion of the force imparted to the object as a result of the impact.

Besides producing protective zones 32 around object 38, tensional forces increase the structural integrity of padding layer 20. The protective covering 12 and padding resist distortion from their relaxed shape by resisting an externally applied force 34 with a "restoring force" 36. The restoring force is related to the amount of pre-stressing of the pouch provided by the curved surfaces of the pouch 10. This prestressing can be modeled as a spring in partial compression. Therefore, prestressing the curved sidewalls increases the amount of energy that the pouch 10 will absorb before its contents are affected.

A strap can also be attached to the inside of the pouch for additional security. The strap can be fastened around the object 38 to prevent the object 38 from shifting inside the pouch.

The pouch can be used to protect nonrectangular objects. In addition, a rectangular form can be placed within the pouch and the form can house objects having different shapes.

Having described preferred embodiments of the invention, other embodiments incorporating its concept may be used. It is felt, therefore, that this invention should not be limited to the disclosed embodiment, but rather should be limited only by the spirit and scope of the appended claims.

What is claimed is:

1. A pouch comprising:

a pair of opposing curved sidewalls comprised of a series of ridges and folds disposed in parallel with a curvature of said pouch, each sidewall comprising:

a padding layer of a closed cell foam; and a casing disposed about an exterior portion of said padding layer, wherein said casing is a semi-rigid plastic layer disposed over the padding layer.

2. The pouch of claim 1 wherein said plastic layer is bonded to the padding layer.

3. The pouch of claim 1 wherein said casing is a molded unit.

4. The pouch of claim 1 further comprising a molded unit between said casing and said closed cell foam padding.

5. The pouch of claim 4 wherein said molded unit is a hard material.

6. An article of manufacture comprising:

a casing of a semi-rigid layer arranged to provide a pair of opposing, connected curved sidewalls, the semi-rigid layer having a series of ridges and folds disposed in parallel with a curvature of said pair of opposing curved sidewalls; and a padding layer of a foam disposed on interior portions of the pair of opposing sidewalls, with the casing being prestressed by being placed in tension.

7. The article of claim 6 wherein the layer is a plastic layer and is bonded to the padding layer.

8. The article of claim 6 wherein said casing is a molded unit.

9. The article of claim 6 wherein tensional forces are provided by the curved sidewalls and ridges and folds to increase structural integrity of the article.

10. The article of claim 6 wherein the sidewalls resist distortion from their relaxed shape by resisting an externally applied force with a restoring force that is related to the amount of pre-stressing of the article provided by the curved surfaces.

* * * * *